US006035938A

United States Patent [19]

Watkins

[11] Patent Number: 6,035,938

[45] Date of Patent: Mar. 14, 2000

[54] WELLHEAD SYSTEM AND METHOD FOR USE IN DRILLING A SUBSEA WELL

[75] Inventor: Bruce J. Watkins, Houston, Tex.

[73] Assignee: Dril-Quip, Inc., Houston, Tex.

[21] Appl. No.: 09/048,385

[22] Filed: Mar. 26, 1998

[51] Int. Cl.[7] ..... E21B 7/12

[52] U.S. Cl. ..... 166/345; 166/348; 166/358; 166/354; 166/368

[58] Field of Search ..... 166/341, 344, 166/345, 348, 358, 359, 367, 368; 285/18

[56] References Cited

U.S. PATENT DOCUMENTS

| | | | |
|---|---|---|---|
| 3,287,030 | 11/1966 | Crain et al. | 166/348 |
| 3,468,559 | 9/1969 | Ahlsone | 166/348 X |
| 4,856,594 | 8/1989 | Jennings | 166/345 X |
| 4,902,044 | 2/1990 | Williams et al. | 166/344 X |
| 5,184,686 | 2/1993 | Gonzalez . | |
| 5,255,743 | 10/1993 | Adam et al. | 166/345 |
| 5,433,274 | 7/1995 | Graff et al. | 166/368 |
| 5,566,761 | 10/1996 | Pallini, Jr. et al. | 166/345 |
| 5,634,671 | 6/1997 | Watkins | 166/344 X |
| 5,878,816 | 3/1999 | Lalor et al. | 166/348 |

FOREIGN PATENT DOCUMENTS 2080902A 2/1982 United Kingdom .

OTHER PUBLICATIONS

Drill–Quip, Inc. Brochure, SS–15, 1997.

*Primary Examiner*—George Suchfield
*Attorney, Agent, or Firm*—Browning Bushman

[57] ABSTRACT

There are disclosed a wellhead system and a method for use in drilling a subsea well from a jackup platform which includes a wellhead housing which is installed on a surface casing of a subsea well. A first riser having a connector on its lower end is lowered over the upper end of the housing as the connector to land on the housing, and a second riser is lowered through the first riser and connector over and onto the upper end of the wellhead housing to form an upward continuation of the bore of the housing. The connector has locking parts which are movable between outer unlocking position to permit the second riser to be lowered onto and raised from the wellhead housing, and inner positions for locking engagement with the upper end of the housing and lower end of the second riser. A casing hanger is lowered through the second hanger and into landed position within the housing bore for suspending an inner casing string within the surface casing.

14 Claims, 8 Drawing Sheets

SR
FR
41
42
33A
MSR
44
35
50
36
26
50
LP
CH
33B

WELLHEAD SYSTEM AND METHOD FOR USE IN DRILLING A SUBSEA WELL

FIELD OF THE INVENTION

This invention relates generally to a wellhead system and method for use in drilling a subsea well. More particularly, it relates to a system and method employing an improved riser system for drilling a subsea well from a jack up platform.

DESCRIPTION OF RELATED ART

Jackup rigs are normally equipped with 21¼ inch 5000 psi and 15⅝" 10,000 psi blowout preventer (BOP) stacks for surface operations. In order to drill a subsea well from a jackup, it's necessary to provide high pressure risers for extension from the subsea wellhead to the surface B.O.P.'s at the platform through which pipe strings may be lowered into the well bore. Since the pipe strings are of successively smaller size, and run to greater depths, they are run through successively smaller, but higher pressure risers. According to standard procedures, the lower end of each riser is releasably connected to the upper end of the wellhead housing by a connector which must be retrieved with the riser, and installed on or replaced by another connector on the next riser to be run. This of course involves considerable time and expense. Thus, the primary object of this invention is to provide a wellhead system and drilling method which enable the risers to be installed and retrieved with a minimum of time and expense.

Some areas of the world require, as part of a wellhead system of this type, a so-called "containment" riser, which, as the name implies, merely provides a protective environment for the riser within it, and thus differs from conventional risers which must contain high pressure fluids. Another object of this invention is to provide a wellhead system and method of this type which are especially well suited for use in such situations.

BRIEF SUMMARY OF THE INVENTION

These and other objects are accomplished, in accordance with the illustrated and preferred embodiment of the invention, by a wellhead system and method of drilling a subsea well wherein a wellhead housing is installed on an outer casing string of the subsea well, a first riser (which may be a containment riser) is lowered into landed position over and connected to the upper end of the housing, and a second riser is lowered through the first riser and onto the upper end of the wellhead housing.

More particularly, the first riser has a connector on its lower end including locking means movable between outer positions, which permit it to be lowered over the upper end of the housing and the lower end of the second riser to be lowered onto and raised from the upper end of the wellhead housing, and inner positions in locking engagement with means on the adjacent ends of the housing and second riser. Upon landing and locking of the second riser, a casing hanger is lowered therethrough for landing within the bore, the well, and, as illustrated, within the bore of the wellhead housing, in order to suspend an inner casing string within the outer casing string. Thus, in accordance with the novel aspects of the present invention, the system and method accomplish the broad object of the invention in that, as compared with prior practices, they require the use and installation of only a single connector. More particularly, and in accordance with additional novel aspects of the invention, the first riser is a containment riser which, in any case, and compared to the drilling risers, remains connected to the wellhead as the subsequent risers are successively installed and retrieved.

In the illustrated and preferred embodiment of the invention, a means is carried by the lower end of the second riser for sealably engaging between its I.D. and the bore of the upper end of the housing as the locking means of the connector is moved to locking position. More particularly, a means is provided for sealing between the second riser and the bore of the first riser, when the second riser is landed on the housing, and for sealing between the casing hanger and the bore of the wellhead housing, when the hanger is landed therein, to thereby seal off the fluid flow within the inner casing.

As illustrated, the system further includes a third riser which, following movement of the locking means to its outer position, and raising of the second riser from within the first riser, is lowered through the first riser and locking means of the connector and onto the upper end of the wellhead housing. The lower end of the third riser also has means adapted to be lockingly engaged by the locking means of the connector as it is moved inwardly to locking position.

More particularly, means are carried by the lower ends of the aligned bores of each of the second and third risers for sealably engaging with the upper end of the bore of the wellhead housing. As illustrated, this means comprises a metal ring sealably engageable with seal surfaces on the ends of the bore of the housing and each of the second and third risers adjacent the bores thereof as the locking means is moved to closed position.

DESCRIPTION OF THE DRAWINGS

In the drawings, wherein like reference characters are used throughout.

DETAILED DESCRIPTION OF THE INVENTION

Figure 1:
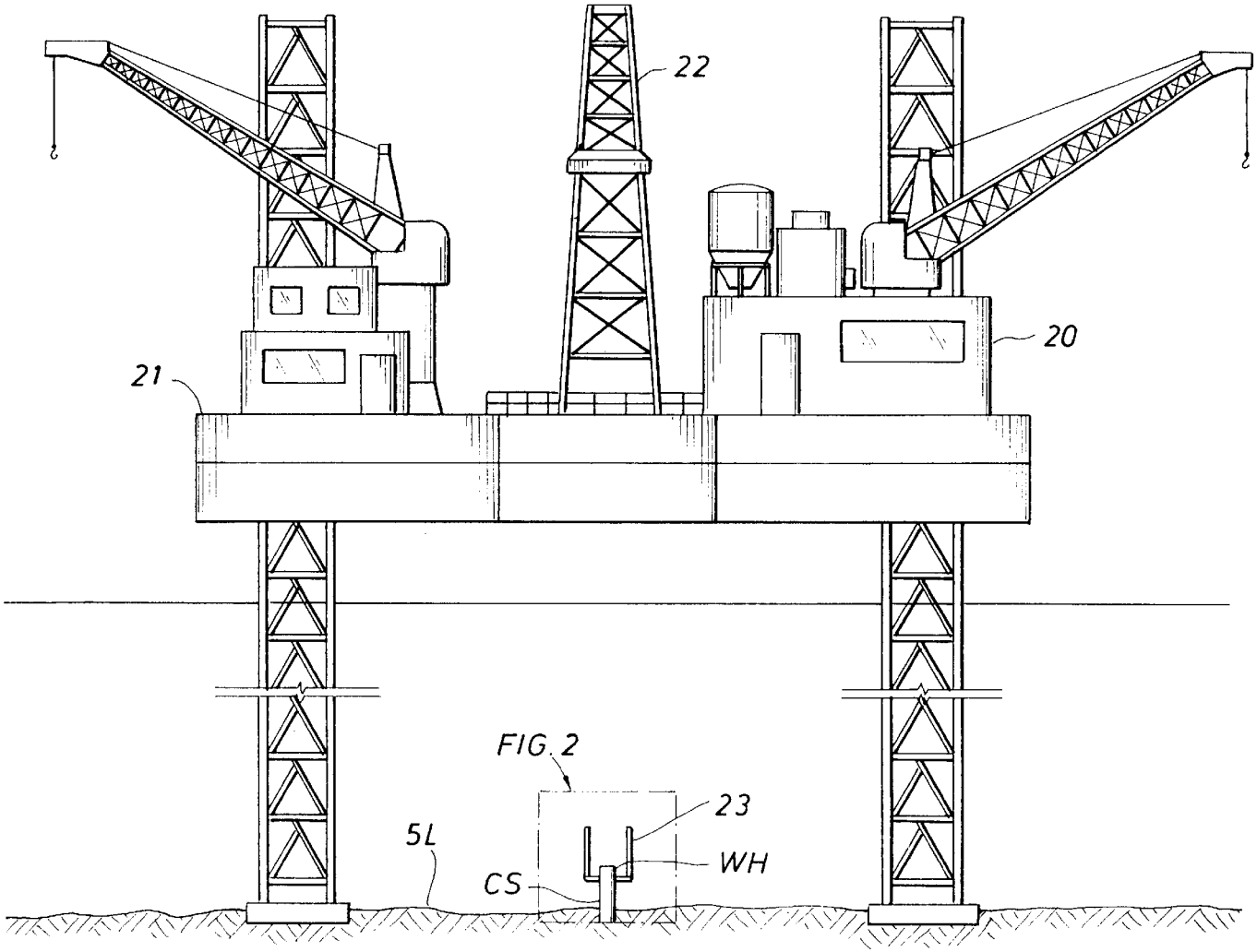
FIG. 1 is a side view of a jackup rig or platform with its derrick located above a subsea wellhead housing.
Figure 2:
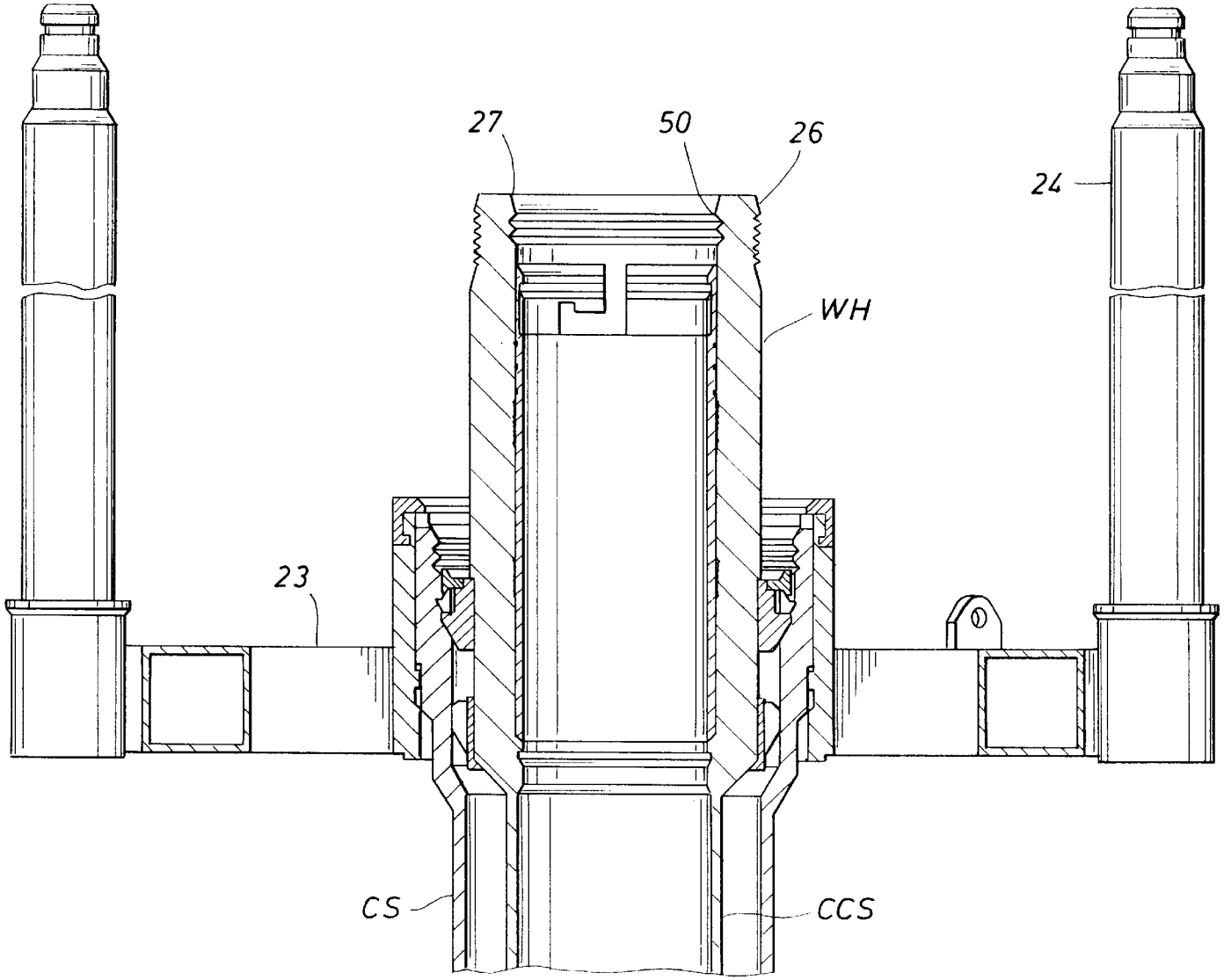
FIG. 2 is an enlarged, vertical-sectional view of the wellhead housing mounted on the upper end of an outer conductor casing.

With reference now to details of the drawings, the jackup rig 20 shown in FIG. 1 is of a conventional construction having a platform 21 supported above a subsea level SL and with a derrick 22 on the platform located generally above a wellhead housing WH installed on the upper end of a surface casing CS. In accordance with conventional practice, and as shown in FIG. 2, the housing, which has locking grooves 26 formed thereabout, and an inwardly and downwardly tapered seal surface 27 on the upper end of its bore has been lowered into and locked within an outer housing on the upper end of a conductor casing string CSS which is lowered into the well bore on a guide base 23. As also shown in FIG. 2, the guide base has upright post 24 which connect with guide cables (not shown) extending upwardly to the rig floor for use in guiding various equipment onto and out of the wellhead housing during drilling and production procedures at the subsea well.

Figure 3:
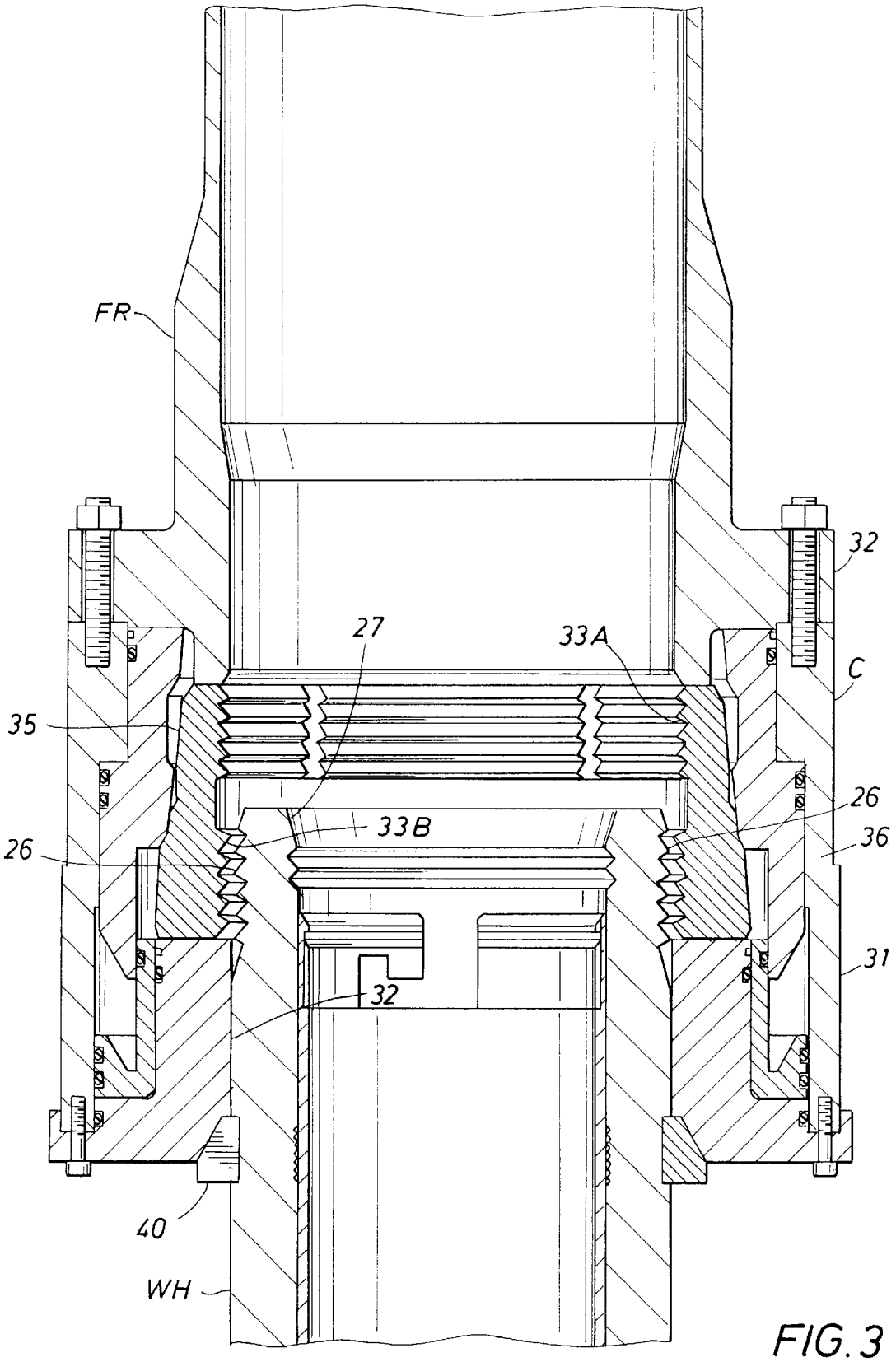
FIG. 3 is a further enlarged sectional view of the upper end of the housing and the lower end of a first outer riser having a connector carried thereby for lowering onto and about the upper end of the housing.

As shown in FIG. 3, a connector C is mounted on the lower end of a first riser FR, which may be a containment riser, for lowering onto and about the upper end of the wellhead housing WH. The connector may be of known construction, such as that shown and described in U.S. Pat. No. 4,902,044, assigned to the assignee of the present Application. Thus, it includes an outer body 31 bolted to a flange on the lower end of the first riser and having a bore for fitting closely about the housing and landing upon a split ring 40 carried within a groove about the outer diameter of the housing beneath the grooves 26.

Figure 4:
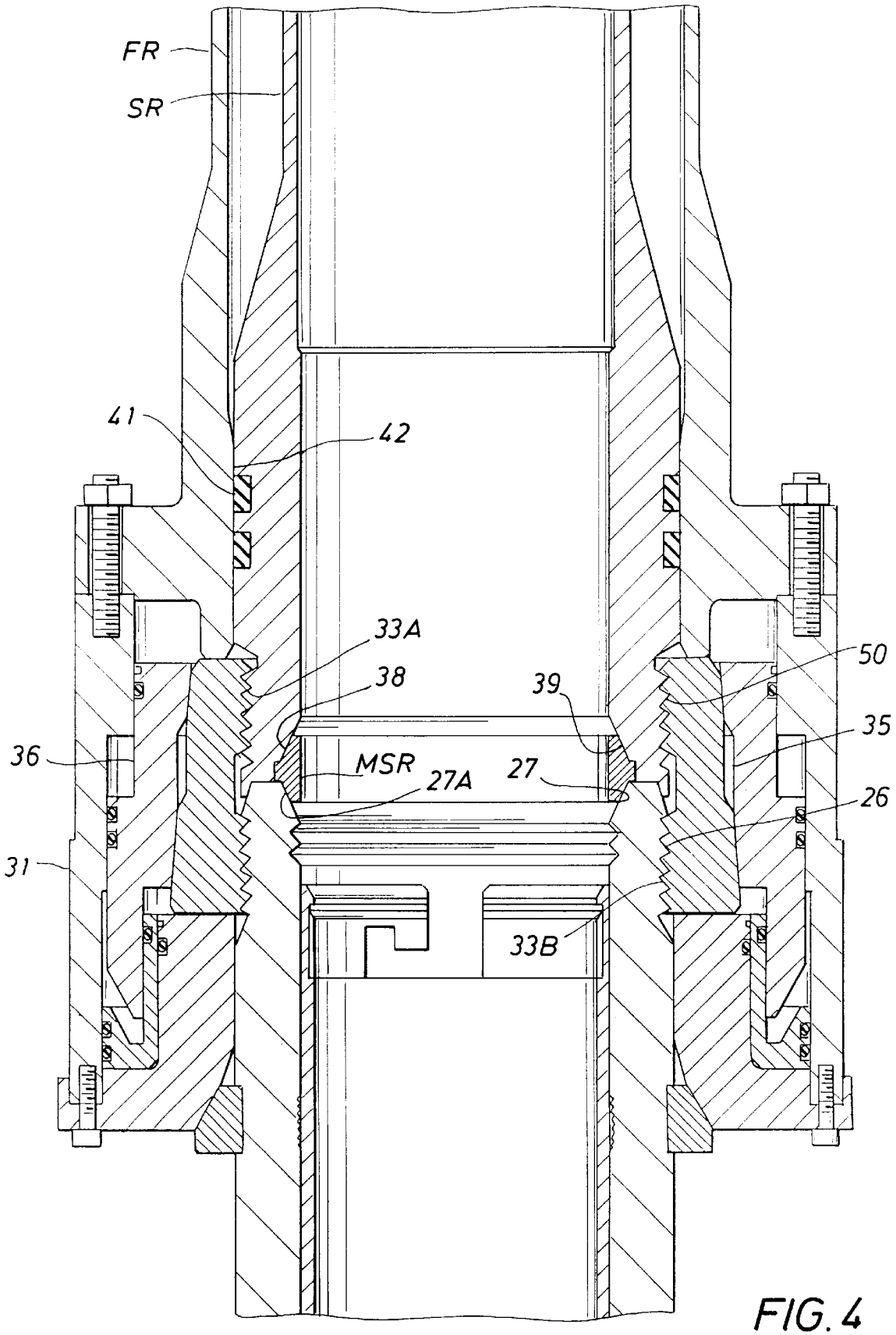
FIG. 4 is a view similar to FIG. 3, but in which a second riser has been lowered through the first riser and onto the upper end of the housing and the locking means of the connector has been inwardly to lock the lower end of the second riser to the housing, with the ends of their bores in sealed relation.

More particularly, and as shown in the aforementioned patent, the connector has locking means including a normally expanded split ring 35 having upper and lower teeth 33A and 33B about its inner diameter carried within a window in the body for radial movement between the normally expanded unlocking position of FIG. 3 and the retracted locking position of FIG. 4 in which its lower teeth 33B are lockably engaged with grooves 26. More particularly, the lock ring is caused to move from its normally expanded unlocking position to its contracted position by means of cam surfaces on a vertically reciprocating piston or cam ring 36 carried within the housing and surrounding follower surfaces on the lock ring. As best described in the above mentioned patent, means are provided for supplying and exhausting hydraulic fluid to and from the upper and lower ends of the casing piston, and thus causing the piston or cam ring to move between locking and unlocking positions.

As shown, the inner diameter of the split locking ring is generally aligned with the ID of the riser when in its expanded, unlocking position so that the upper and lower teeth 33A and 33B on the ID of the lock ring are within the window to permit the lower teeth to be lowered over the grooves 26 about the upper end of the housing.

As shown in FIG. 4, when the cam ring is raised to permit the locking ring to expand, the lower end of a second riser SR may be lowered through the first or containment riser FR and upper teeth 33A of the lock ring to land on the upper end of the wellhead housing. As shown, grooves 50 are formed about the lower outer end of the second riser in position to be opposite the upper locking teeth 33A of the lock ring as the riser is landed. Thus, upon lowering the cam ring, the lock ring is moved inwardly to move its upper teeth 33A into locking engagement with the grooves 50 about the lower end of the second riser and its lower locking teeth 33B into locking engagement with the grooves 26 about the upper end of the wellhead housing, thus connecting the lower end of the second riser and upper end of the wellhead housing in end-to-end, aligned relation.

A metal seal ring MSR carried by the lower end of the I.D. of the second riser SR has a downwardly and inwardly tapered surface 27A for sealably engaging the seal surface 27 on the upper end of the bore of the housing. More particularly, the upper end of the ring has an inwardly and upwardly tapered surface 38 held in engagement with a similarly tapered surface 39 on the lower end of the I.D. of the second riser. The upper teeth 33A on the connector lock ring, like the lower teeth 33B, have tapered surfaces for sliding over similarly shaped surfaces of the grooves about the lower end of the riser and the upper end of the wellhead housing to wedge them into tight engagement. Upon engagement of the locking teeth 33A of the lock ring with grooves 50 about the lower end of the second riser and lower teeth 33B with grooves 26 about the housing, the tapered seal surfaces on the riser and housing bore are slidable over those on the ring MSR to force them into sealing engagement.

As also shown in FIG. 4, elastomeric seal rings 41 are carried within grooves about the outer diameter of the second riser SR for sealably engaging a reduced lower portion 42 of the bore through the first riser as the second riser is lowered into it. Thus, these elastomeric seal rings cooperate with the metal seal ring MSR engaged with the ends of the bores of the second riser and housing to contain pressure within the wellhead housing and riser.

Figure 5A:
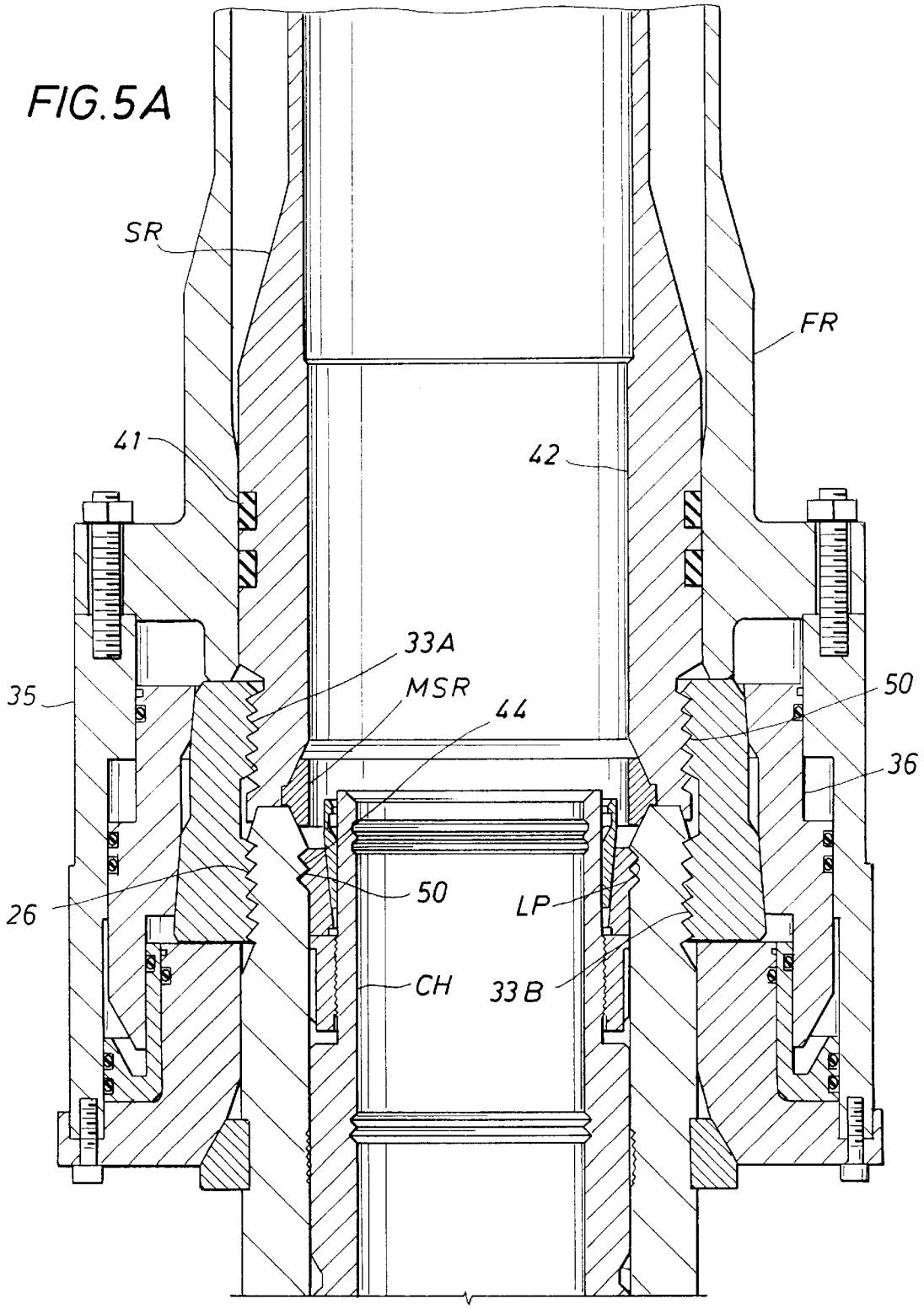
FIGS. 5A and 5B are sectional views of the upper and lower portions, respectively, of the wellhead housing upon lowering of a casing hanger through the second riser and into landed position within the housing to suspend a surface casing string within the conductor casing.
Figure 5B:
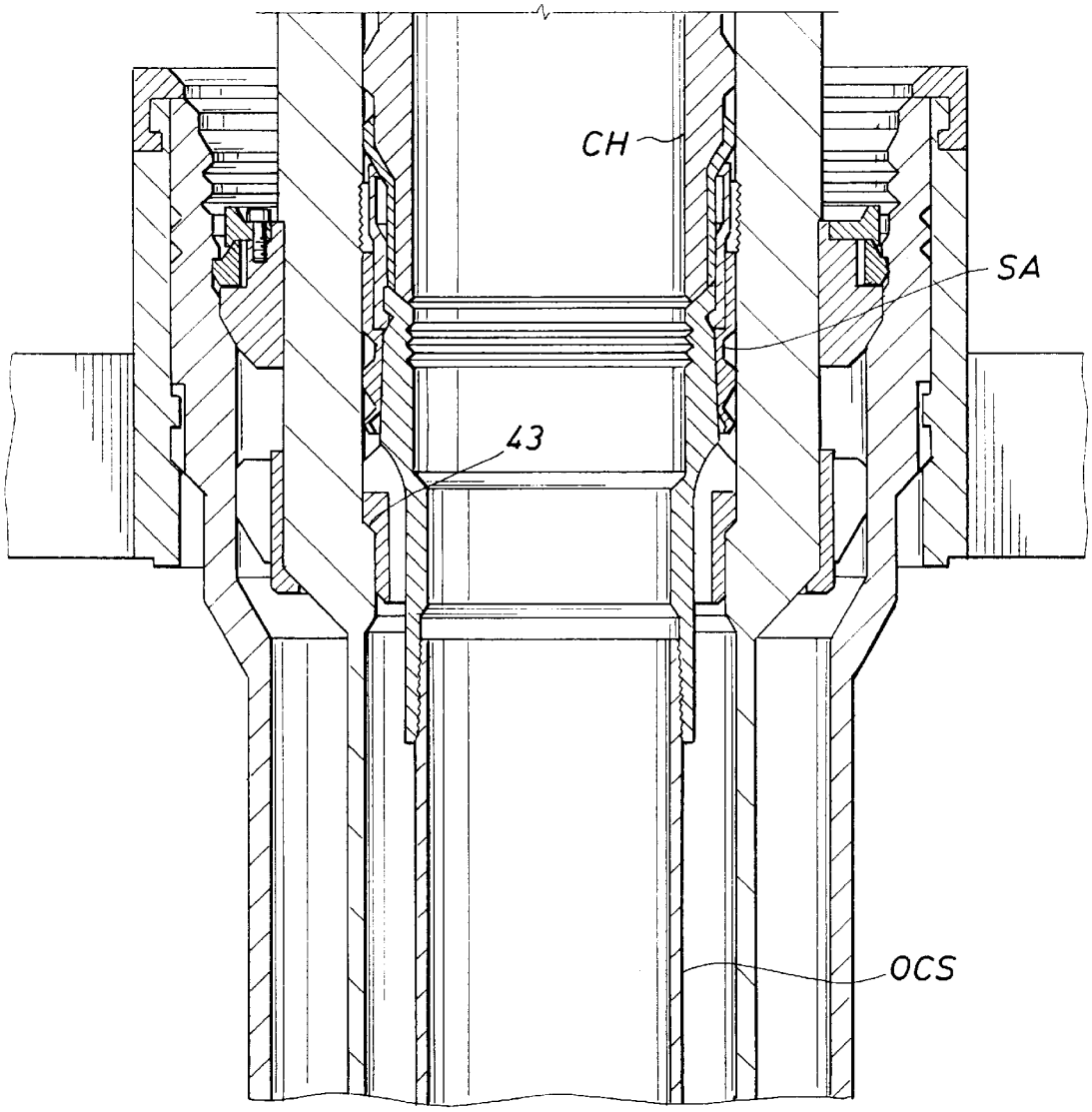

As shown in FIGS. 5A and 5B, a casing hanger CH has been lowered through the second riser SR and into landed position on a shoulder 43 within the bore of the housing. This hanger may be of well known construction including a vertical bore from which an outer casing string OCS is suspended, and a removable seal assembly SA is connected thereabout for sealably engaging between the outer diameter of the casing hanger and the inner diameter of the bore of the housing so as to close the annulus between them.

The casing hanger includes an upper extension which, upon landing, is disposed generally opposite grooves 44 about the housing bore. It has additional locking parts LP for engaging the grooves to hold the casing hanger down and also to locate the upper end of the extension to receive and support additional parts, such as a tubing hanger, during a subsequent step of completion of the well.

Figure 6A:
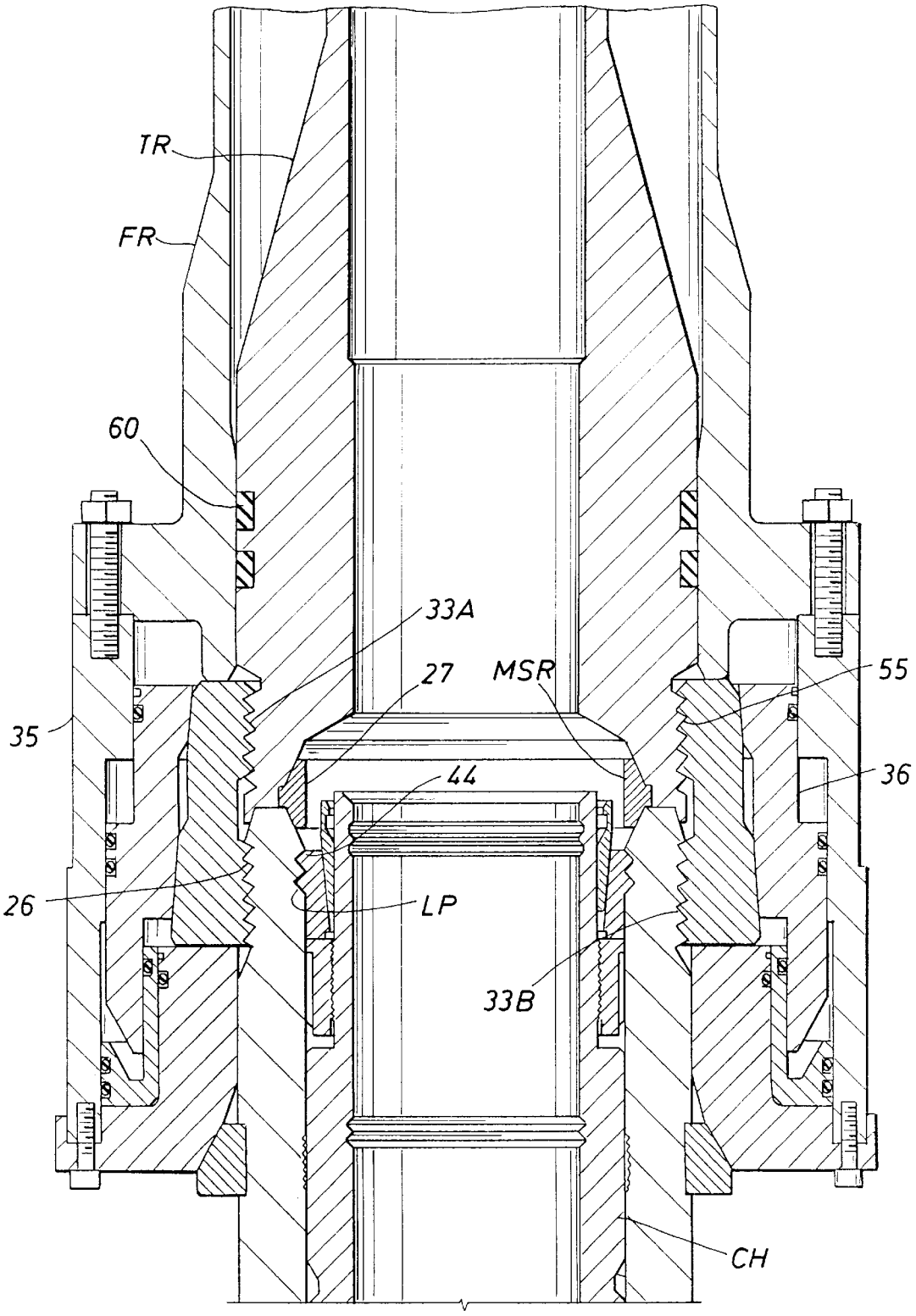
FIGS. 6A and 6B are views similar to FIGS. 5A and 5B, respectively, but in which the locking means of the connector has been moved outwardly to release the second riser for retrieval through the first riser, a third riser has been lowered through the first riser and over and onto the upper end of the housing, and the locking means of the connector has again moved inwardly to lock the third riser onto the upper end of the housing with the ends of their bores in sealed engagement.
Figure 6B:
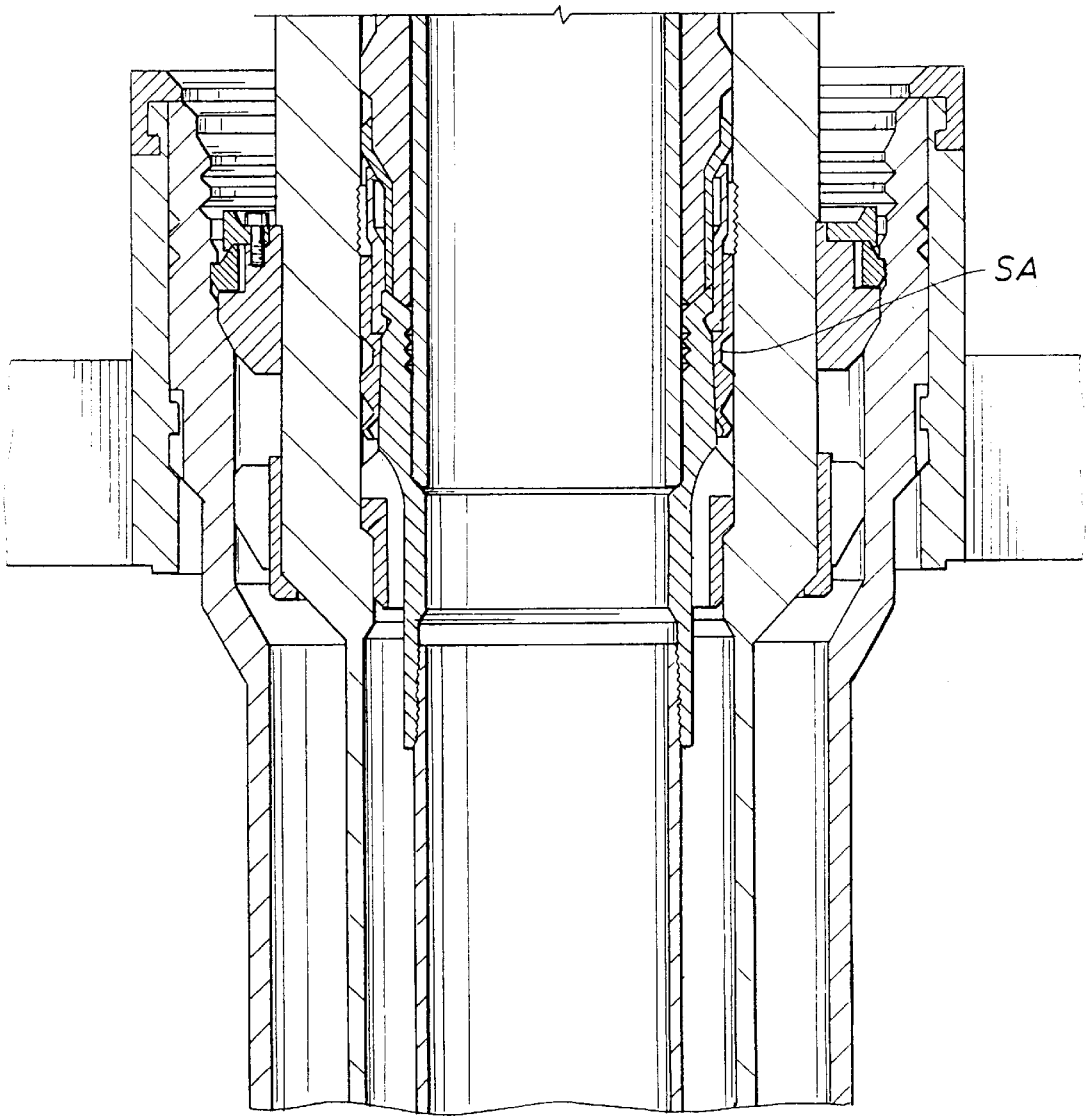

Upon installation of the casing hanger CH, the cam ring of the connector is raised to permit the lock ring to expand to its unlocking position, as shown in FIG. 3, whereby the second riser SR may be raised from the upper end of the wellhead housing for retrieval from within the first containment riser FR. At this time, a third riser TR is lowered through the first riser and upper end of the lock ring onto the upper end of the wellhead housing, as shown in FIG. 6A. Similarly to the second riser, the lower end of the third riser has grooves 55 thereabout adapted to be disposed opposite the upper teeth 33A of the retracted lock ring when its lower end lands on the upper end of the housing. It also carries a metal seal ring MSR thereabout in position for landing on the seal surface 27 of the upper of the bore of the wellhead housing.

Thus, with the third riser so landed, the cam ring 36 of the connector is again lowered to force the normally expanded lock ring inwardly and thus move its upper and lower teeth 33A and 33B into the grooves 55 about the lower end of the third riser and grooves 26 about upper end of the wellhead housing, thus locking the lower end of the riser TR to the upper end of the wellhead housing. At the same time, the lower end of the seal ring MSR will be forced into sealing engagement with the seal surfaces on the ends of the bores of the wellhead housing and I.D. of the third riser, as was described in connection with the seal ring carried by the lower end of the second riser. As was also true of the second riser, elastomeric seal rings 60 are carried within grooves about the reduced diameter portion of the lower end of the I.D. through the first riser to form a seal therewith, and thus cooperate with metal seal ring MSR to contain pressure within the inner casing, housing, and riser pipe. As shown, its O.D. is the same, but the I.D. of the third riser is smaller than the bore through the I.D. of the second riser and generally aligned with the casing hanger CH and the inner casing string CH suspended from its lower end. The bores are nevertheless of a size to accommodate the lowering of suitable equipment including another casing or tubing hanger downwardly through the third riser and for suspending a smaller casing string on tubing string within the intermediate casing string.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope if the claims.

Because many possible embodiments may be made of the invention without departing from the scope thereof, it is to be understood that all matters herein set forth or shown in the accompanying drawings is to be interpreted as illustrative and not in a limiting sense.

What is claimed is:

1. A wellhead system for use in drilling a subsea well from a jack up platform, comprising a wellhead housing adapted to be installed on an outer casing of a subsea well, a first riser adapted to be lowered into landed position over the upper end of the housing, and a second riser adapted to be lowered through the first riser and onto the upper end of the wellhead housing to form an upward continuation of the bore of the housing, said first riser having a connector on its lower end including locking means movable between outer positions, which permit them to be lowered over the upper end of the housing and the lower end of the second riser to be lowered onto and raised from the wellhead housing, and inner positions in locking engagement with means on the adjacent ends of the housing and second riser, and a casing hanger adapted to be lowered through the second riser for landing within the well in order to suspend an inner casing string within the outer casing string.

2. As in claim 1, wherein the bore of the wellhead housing has means on which the casing hanger is landed.

3. A wellhead system as in claim 1, including means carried by the lower end of the second riser for sealably engaging between its bore and the bore of the housing as the locking means of the connector is moved to locking position.

4. As in claim 3, wherein said sealably engaging means comprises a seal ring sealably engageable with seal surfaces in the ends of the housing and second riser adjacent the bores thereof.

5. A wellhead system in claim 1, including means for sealing between the second riser and the bore of the first riser when the first riser is landed on the housing, and means for sealing between the casing hanger and the bore of the wellhead housing when the casing hanger is landed therein.

6. As in claim 1, including a third riser adapted to be lowered through the first riser and locking means and onto the upper end of the wellhead housing, following movement of the locking means to its outer position and withdrawal of the second riser from within the first riser, the lower end of the third riser having means adapted to be engaged by the locking means of the connector as the locking means is moved inwardly to locking position.

7. As in claim 6, including means carried by the lower ends of each of the second and third risers for sealably engaging between its bore and the bore of the wellhead housing as the locking means is moved to locking position.

8. As in 7, wherein said sealably engaging means comprises a seal ring sealably engageable with seal surfaces on the ends of the housing and each of the second and third risers adjacent the bores thereof.

9. In a method of drilling a subsea well from a jack up platform, wherein a a wellhead housing is installed on an outer casing string of the subsea well, the steps of providing a first riser having a connector on its lower end which has locking means movable inwardly and outwardly between locking and unlocking positions, lowering the first riser with its locking means in its outer position to permit it to be lowered over and landed on the upper end of the housing, providing a second riser, lowering the second riser through the first riser and the onto the upper end of the wellhead housing to form an upward continuation of the bore of the housing, moving the locking means of the connector inwardly into locking engagement with means on the adjacent ends of the housing and second riser to lock the second riser to the housing, providing a casing hanger having an inner casing string suspended therefrom, and lowering the casing hanger through the second riser and into landed position within the well in order to suspend a casing string within the outer casing string.

10. In the method of claim 9, wherein the casing hanger is landed in the bore of the wellhead housing.

11. In the method of claim 9, including the further step of providing means on the lower end of the second riser for sealably engaging between its bore and the bore of the housing as the locking means of the connector is moved to locking position.

12. In the method of claim 8, including the further step of providing means on the second riser for sealing with the bore of the first riser when the second riser is landed on the housing, and providing means on the casing hanger for sealing with the bore of the wellhead housing when the hanger is landed therein.

13. In the method of claims 8, including the further steps of moving the locking means of the connector to its outer position, withdrawing the second riser from within the first riser, providing a third riser having means about its lower end adapted to be engaged by the locking means of the connector, and lowering the third riser through the locking means and onto the upper end of the wellhead housing in alignment with the bore through the casing hanger, and moving the locking means into locking engagement with the means about the lower end of the third riser.

14. In the method of claim 13, including the further steps of providing means on the lower end of the third riser for sealably engaging between its bore and the bore of the upper end of the wellhead housing as the locking means is moved to locking position.

* * * * *